US010076161B2

(12) United States Patent
Walden

(10) Patent No.: US 10,076,161 B2
(45) Date of Patent: Sep. 18, 2018

(54) APPARATUS AND METHOD FOR AN ADJUSTABLE STRAP SECURING DEVICE

(71) Applicant: Maranda Nicole Walden, Chattanooga, TN (US)

(72) Inventor: Maranda Nicole Walden, Chattanooga, TN (US)

( * ) Notice: Subject to any disclaimer, the term of this patent is extended or adjusted under 35 U.S.C. 154(b) by 273 days.

(21) Appl. No.: 14/808,004

(22) Filed: Jul. 24, 2015

(65) Prior Publication Data

US 2016/0021986 A1 Jan. 28, 2016

Related U.S. Application Data

(60) Provisional application No. 61/999,362, filed on Jul. 24, 2014.

(51) Int. Cl.

| | |
|---|---|
| ***A44B 11/06*** | (2006.01) |
| ***A44B 13/00*** | (2006.01) |
| ***A44B 11/12*** | (2006.01) |

(52) U.S. Cl.

CPC ..... *A44B 11/12* (2013.01)

(58) Field of Classification Search

CPC ..... A44B 11/12

See application file for complete search history.

(56) References Cited

U.S. PATENT DOCUMENTS

| | | | | | |
|---|---|---|---|---|---|
| 754,714 | A * | 3/1904 | Sedlmair | A44B 11/12 | 24/191 |
| 1,144,906 | A * | 6/1915 | Klatt et al. | A44B 11/12 | 24/166 |
| 2,807,067 | A * | 9/1957 | Bayon | A44B 11/12 | 24/170 |
| 2,954,594 | A * | 10/1960 | Finken | A44B 11/12 | 24/170 |
| 4,158,951 | A * | 6/1979 | Cedar | A44C 5/2042 | 24/265 BC |
| 5,653,003 | A * | 8/1997 | Freeman | B60R 22/19 | 24/298 |
| 7,043,939 | B2 * | 5/2006 | Imahashi | A44C 9/0038 | 63/15.5 |

* cited by examiner

*Primary Examiner* — Robert John Sandy
*Assistant Examiner* — Louis A Mercado
(74) *Attorney, Agent, or Firm* — Chambliss, Bahner & Stophel, P.C.

(57) ABSTRACT

An adjustable strap securing device having a first side adapted to contact the adjustable strap and having a loop end and a tail end, a second side attached to the loop end of the first side at an angle relative to the first side and having a second side distal end, a second side fastener disposed adjacent to the second side distal end, a third side attached to the straight end of the first side at an angle relative to the first side and having a third side distal end, a third side fastener disposed adjacent to the third side distal end. The second side fastener and the third side fastener are adapted to releasably engage the adjustment device of the adjustable strap. A method for providing an adjustable strap securing device and securing the adjustable strap securing device around an adjustable strap.

9 Claims, 9 Drawing Sheets

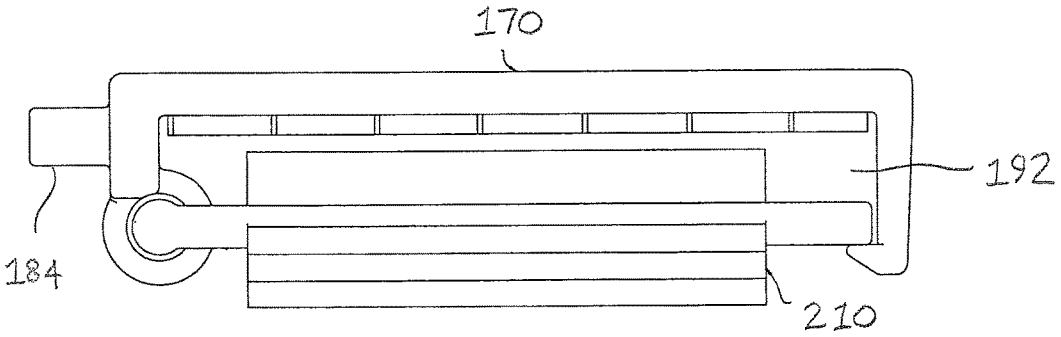
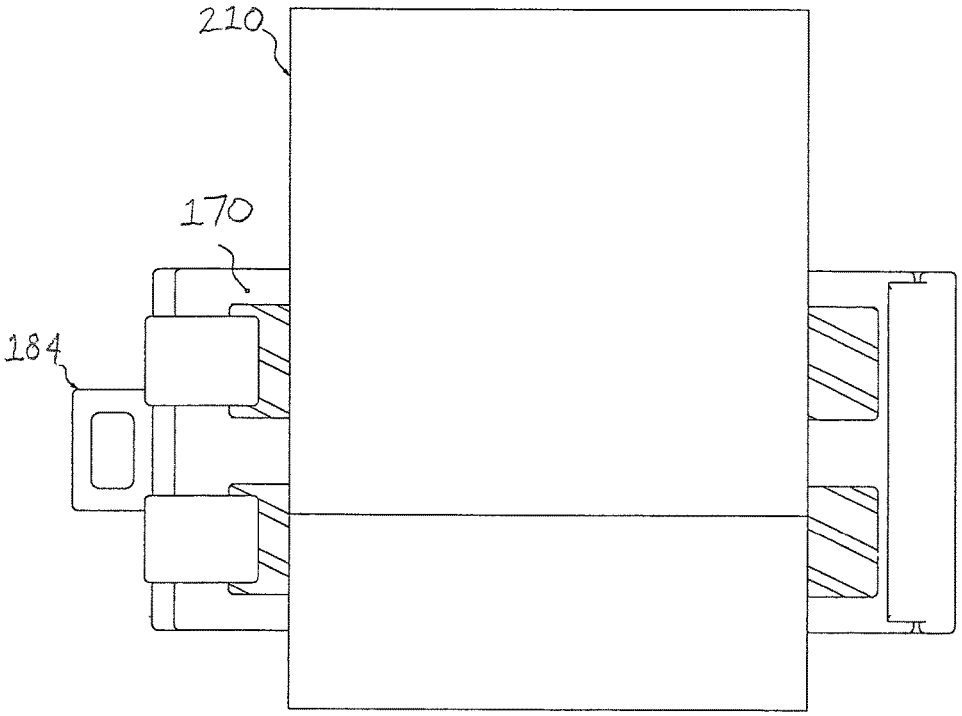
FIGURE 17

FIGURE 18
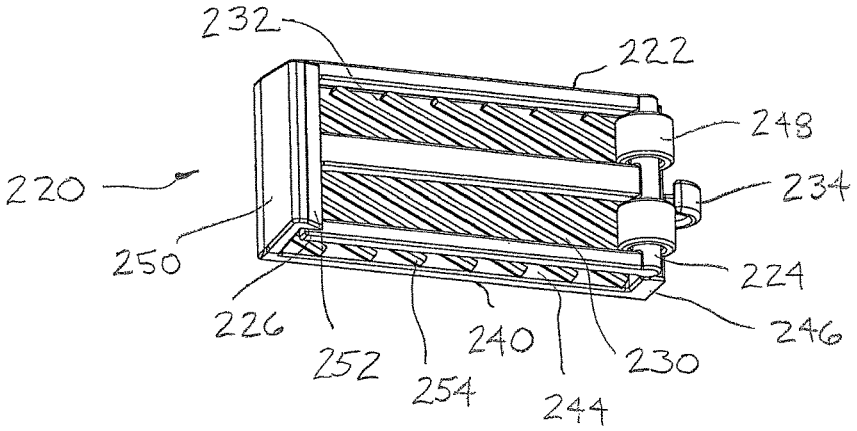
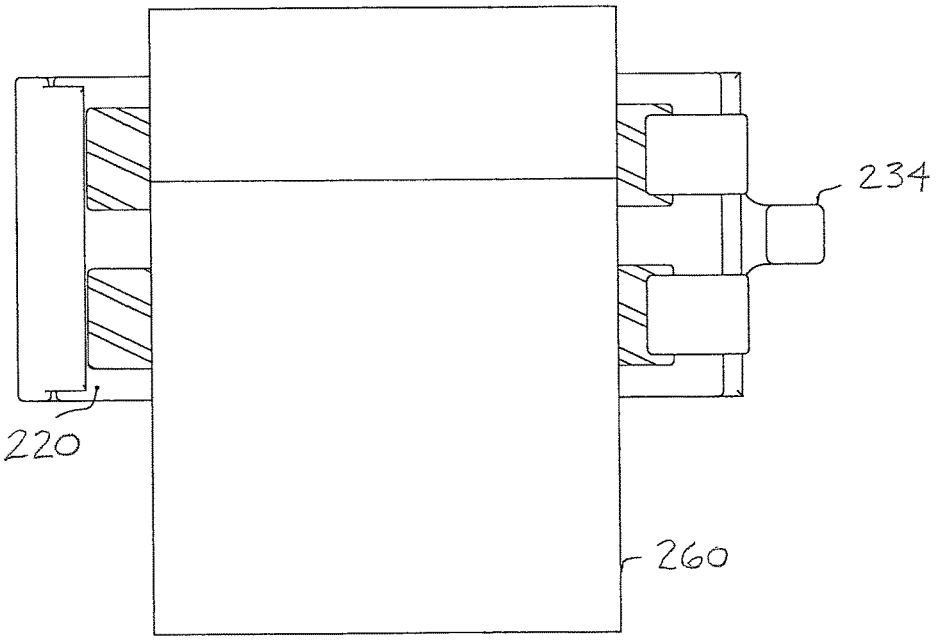
FIGURE 19
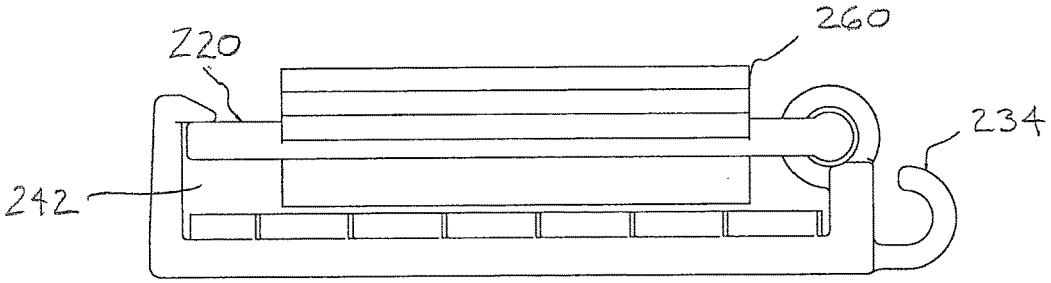
FIGURE 20

APPARATUS AND METHOD FOR AN ADJUSTABLE STRAP SECURING DEVICE

CROSS-REFERENCES TO RELATED APPLICATIONS/PATENTS

This application relates back to and claims the benefit of priority from U.S. Provisional Application for Patent No. 61/999,362 entitled "Adjustable Strap Clamp" and filed on Jul. 24, 2014.

FIELD OF THE INVENTION

The present invention relates generally to devices adapted for use on adjustable straps, and particularly to strap securing devices adapted for use on adjustable straps.

BACKGROUND AND DESCRIPTION OF THE PRIOR ART

It is known to use adjustment devices for adjusting the length of an adjustable strap and retain the strap at the desire length. Conventional adjustment devices, however, suffer from one or more disadvantages. For example, conventional adjustment devices do not sufficiently retain the desired length of the adjustable strap. Conventional adjustment devices also damage the adjustable strap. Conventional adjustment devices are also not aesthetically appealing. In addition, conventional adjustment devices are not adapted to be removably attached to each other.

It would be desirable, therefore, if an apparatus and method for an adjustable strap securing device could be provided that would sufficiently retain the desired length of the adjustable strap. It would also be desirable if such an apparatus and method for an adjustable strap securing device could be provided that would not damage the adjustable strap. It would be further desirable if such an apparatus and method for an adjustable strap securing device could be provided that would be aesthetically appealing. It would be still further desirable if such an apparatus and method for an adjustable strap securing device could be provided that would be adapted to be removably attached to another adjustable strap securing device.

Advantages of the Preferred Embodiments of the Invention

Accordingly, it is an advantage of the preferred embodiments of the invention claimed herein to provide an apparatus and method for an adjustable strap securing device that sufficiently retains the desired length of the adjustable strap. It is also an advantage of the preferred embodiments of the invention claimed herein to provide an apparatus and method for an adjustable strap securing device that does not damage the adjustable strap. It is another advantage of the preferred embodiments of the invention claimed herein to provide an apparatus and method for an adjustable strap securing device that is aesthetically appealing. It is a further advantage of the preferred embodiments of the invention claimed herein to provide an apparatus and method for an adjustable strap securing device that is adapted to be removably attached to another adjustment device.

Additional advantages of the preferred embodiments of the invention will become apparent from an examination of the drawings and the ensuing description.

SUMMARY OF THE INVENTION

The apparatus of the invention comprises an adjustable strap securing device adapted to secure an adjustable strap having an adjustment device. The preferred adjustable strap securing device comprises a first side that is adapted to contact the adjustable strap and having a loop end and a tail end, a second side that is attached to the loop end of the first side at an angle relative to the first side and having a second side distal end, a second side fastening means that is disposed adjacent to the second side distal end, a third side this is attached to the straight end of the first side at an angle relative to the first side and having a third side distal end, a third side fastening means that is disposed adjacent to the third side distal end. In the preferred embodiments of the adjustable strap securing device, the second side fastening means and the third side fastening means are adapted to releasably engage the adjustment device of the adjustable strap, and the first side contacts the adjustable strap when the second side fastening means and the third side fastening means releasably engage the adjustment device of the adjustable strap.

The method of the invention comprises a method for securing an adjustable strap. The preferred method comprises providing an adjustable strap securing device. The preferred method also comprises securing the adjustable strap securing device around an adjustable strap.

BRIEF DESCRIPTION OF THE DRAWINGS

The presently preferred embodiments of the invention are illustrated in the accompanying drawings, in which like reference numerals represent like parts throughout, and in which:

FIG. 16 is a bottom view of the preferred adjustable strap securing device illustrated in FIGS. 14-15 shown with an exemplary adjustable strap.

FIG. 17 is a back view of the preferred adjustable strap securing device illustrated in FIGS. 14-16 shown with an exemplary adjustable strap.

FIG. 18 is a perspective back view of a fifth alternative embodiment of the adjustable strap securing device in accordance with the present invention.

FIG. 19 is a back view of the preferred adjustable strap securing device illustrated in FIG. 18 shown with an exemplary adjustable strap.

FIG. 20 is a bottom view of the preferred adjustable strap securing device illustrated in FIGS. 18-19 shown with an exemplary adjustable strap.

DESCRIPTION OF THE PREFERRED EMBODIMENTS OF THE INVENTION

Figure 1:
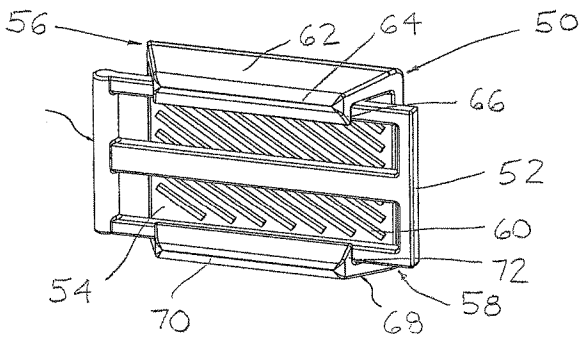
FIG. 1 is a perspective back view of the preferred embodiment of the adjustable strap securing device in accordance with the present invention shown with an exemplary adjustment device.

Referring now to the drawings, the preferred embodiments of the apparatus and method for an adjustable strap securing device in accordance with the present invention is illustrated by FIGS. 1 through 22. As shown in FIGS. 1-22, the preferred adjustable strap securing device is adapted to secure an adjustable strap. Referring now to FIG. 1, a perspective back view of the preferred embodiment of the adjustable strap securing device in accordance with the present invention is illustrated with an exemplary adjustment device. As shown in FIG. 1, the preferred adjustable strap securing device is generally designated by reference numeral 50. Preferred adjustable strap securing device 50 is adapted to secure an adjustable strap (see FIGS. 2-3) having adjustment device 52. Preferred adjustable strap securing device 50 comprises first side 54 which is adapted to contact the adjustable strap and has loop end 56 and tail end 58. Preferably, first side 54 comprises raised portion 60. Preferred adjustable strap securing device 52 also comprises second side 62 which is attached to loop end 56 of first side 54 at an angle relative to the first side and has second side distal end 64. Preferred adjustable strap securing device 50 further comprises a second side fastening means such as second side protrusion 66 which extends from second side distal end 64. In addition, preferred adjustable strap securing device 50 comprises third side 68 which is attached to tail end 58 of first side 54 at an angle relative to the first side and has third side distal end 70. Further, preferred adjustable strap securing device 50 comprises a third side fastening means such as third side protrusion 72 which extends from third side distal end 70. While second side protrusion 66 and third side protrusion 72 are the preferred fastening means, it is contemplated within the scope of the invention that the second side fastening means and the third side fastening means may by any suitable device, mechanism, assembly, or combination thereof such as hook and loop fasteners, snaps, buttons, laces, magnets, and the like. It is also contemplated within the scope of the invention that the second side fastening means and the third side fastening means may be different from each other.

Figure 2:
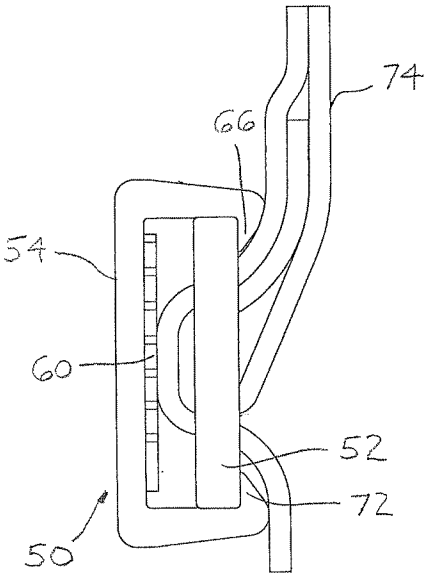
FIG. 2 is a right side view of the preferred adjustable strap securing device illustrated in FIG. 1 shown with an exemplary adjustable strap and adjustment device.

Referring now to FIG. 2, a right side view of preferred adjustable strap securing device 50 is illustrated with an exemplary adjustable strap and adjustment device 52. As shown in FIG. 2, exemplary adjustable strap is designated generally by reference numeral 74. As also shown in FIG. 2, preferred second side protrusion 66 and third side protrusion 72 are adapted to releasably engage adjustment device 52 of adjustable strap 74. Further, preferred raised portion 60 of first side 54 contacts adjustable strap 74 when second side protrusion 66 and third side protrusion 72 releasably engage adjustment device 52 of the adjustable strap.

Figure 3:
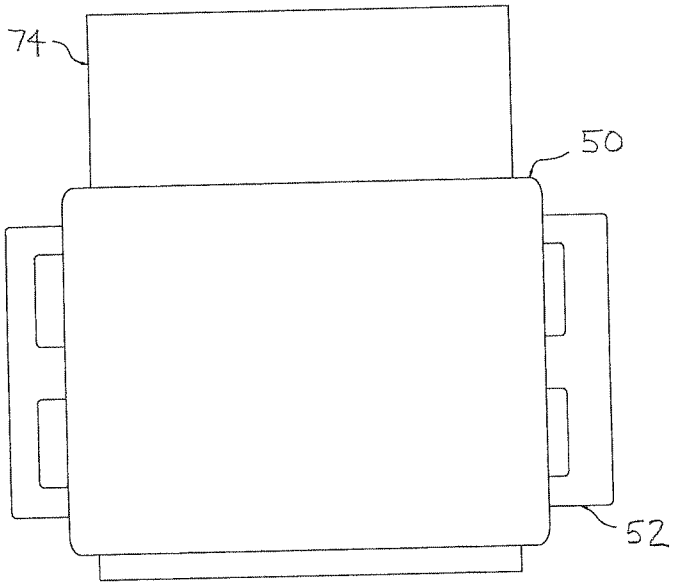
FIG. 3 is a front view of the preferred adjustable strap securing device illustrated in FIGS. 1-2 shown with an exemplary adjustable strap and adjustment device.

Referring now to FIG. 3, a front view of preferred adjustable strap securing device 50 is illustrated with exemplary adjustable strap 74 and adjustment device 52. While FIGS. 1-3 illustrate the preferred configuration and arrangement of adjustable strap securing device 50, it is contemplated within the scope of the invention that the adjustable strap securing device may be of any suitable configuration and arrangement. It is further contemplated within the scope of the invention that preferred adjustable strap securing device 50 comprises a connecting means such as a hook, a loop, and the like.

Figure 4:
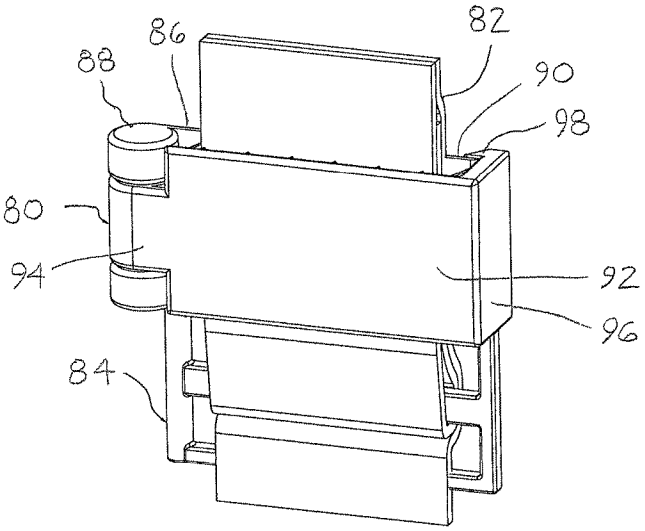
FIG. 4 is a perspective front view of a first alternative embodiment of the adjustable strap securing device in accordance with the present invention shown with an exemplary adjustment device.

Referring now to FIG. 4, a perspective front view of a first alternative embodiment of the adjustable strap securing device in accordance with the present invention is illustrated with an exemplary adjustment device. As shown in FIG. 4, the first alternative embodiment of the adjustable strap securing device is designated generally by reference numeral 80. Preferred adjustable strap securing device 80 is adapted for use on adjustable strap 82 having adjustment device 84. Preferred adjustable strap securing device 80 comprises first member 86 which has first member proximal end 88 and first member distal end 90. Preferably, first member 86 comprises a raised portion. Preferred adjustable strap securing device 80 also comprises second member 92 which has second member proximal end 94 and second member distal end 96. Preferably, second member 92 also comprises a raised portion. In addition, preferred adjustable strap securing device 80 comprises a fastening means such as protrusion 98. Preferably, the fastening means is disposed on at least one of first member distal end 90 and second member distal end 96. In the preferred embodiments of adjustable strap securing device 80, second member proximal end 94 is pivotally attached to first member proximal end 88, and the fastening means is adapted to releasably retain first member 86 and second member 92 around adjustable strap 82. Also in the preferred embodiments of adjustable strap securing device 80, the raised portion of first member 86 and/or second member 92 contacts adjustable strap 82 when the fastening means releasably retains the first member and the second member around the adjustable strap. While FIG. 4 illustrates the preferred configuration and arrangement of the fastening means, it is contemplated within the scope of the invention that the fastening means may be of any suitable configuration and arrangement such as hook and loop fasteners, snaps, buttons, laces, magnets, and the like.

Figure 6:
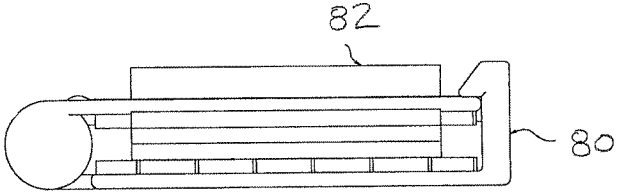
FIG. 6 is a top view of the preferred adjustable strap securing device illustrated in FIGS. 4-5 shown with an exemplary adjustable strap and adjustment device.
Figure 5:
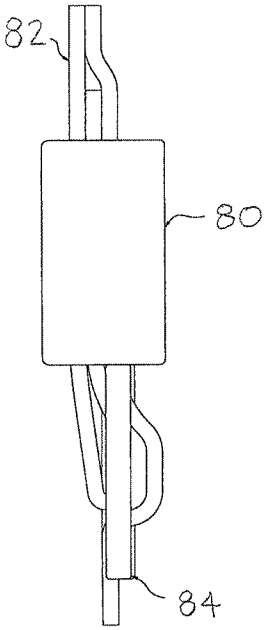
FIG. 5 is a right side view of the preferred adjustable strap securing device illustrated in FIG. 4 shown with an exemplary adjustable strap and adjustment device.

Referring now to FIG. 5, a right side view of preferred adjustable strap securing device 80 is illustrated with exemplary adjustable strap 82 and adjustment device 84. Referring now to FIG. 6, a top view of preferred adjustable strap securing device 80 is illustrated with exemplary adjustable strap 82. While FIGS. 4-6 illustrate the preferred configuration and arrangement of adjustable strap securing device 80, it is contemplated within the scope of the invention that the adjustable strap securing device may be of any suitable configuration and arrangement. It is further contemplated within the scope of the invention that at least one of first member 86 and second member 92 comprises a connecting means such as a hook, a loop, and the like.

Figure 7:
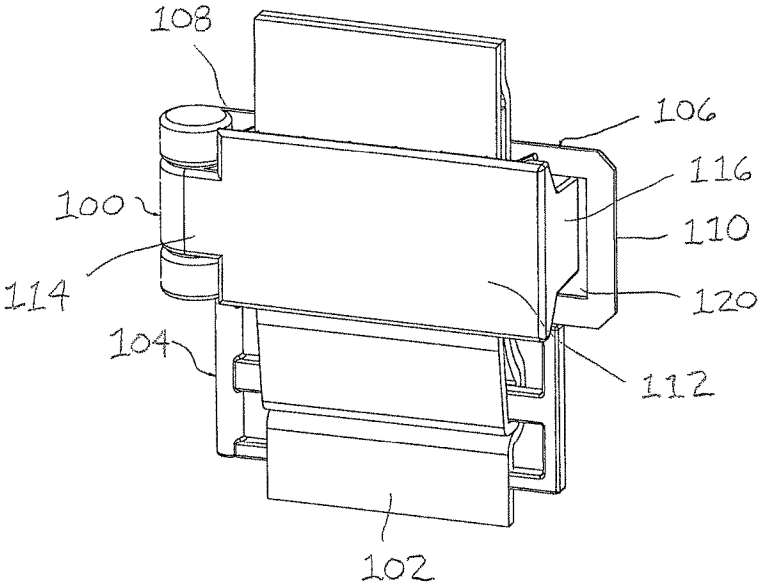
FIG. 7 is a perspective front view of a second alternative embodiment of the adjustable strap securing device in accordance with the present invention shown with an exemplary adjustable strap and adjustment device.

Referring now to FIG. 7, a perspective front view of a second alternative embodiment of the adjustable strap securing device in accordance with the present invention is illustrated with an exemplary adjustable strap and adjustment device. As shown in FIG. 7, the second alternative embodiment of the adjustable strap securing device is designated generally by reference numeral 100. Preferred adjustable strap securing device 100 is adapted for use on adjustable strap 102 having adjustment device 104. Preferred adjustable strap securing device 100 comprises first member 106 which has first member proximal end 108 and first member distal end 110.

Preferably, first member 106 comprises a raised portion. Preferred adjustable strap securing device 100 also comprises second member 112 which has second member proximal end 114 and second member distal end 116. Preferably, second member 112 also comprises a raised portion. In addition, preferred adjustable strap securing device 100 comprises a fastening means such as protrusion 118 (see FIG. 9) and aperture 120. Preferably, the fastening means is disposed on at least one of first member distal end 110 and second member distal end 116. In the preferred embodiments of adjustable strap securing device 100, second member proximal end 104 is pivotally attached to first member proximal end 108, and the fastening means is adapted to releasably retain first member 106 and second member 112 around adjustable strap 102. Also in the preferred embodiments of adjustable strap securing device 100, the raised portion of first member 106 and/or second member 112 contacts adjustable strap 102 when the fastening means releasably retains the first member and the second member around the adjustable strap.

While FIG. 7 illustrates the preferred configuration and arrangement of the fastening means, it is contemplated within the scope of the invention that the fastening means may be of any suitable configuration and arrangement such as hook and loop fasteners, snaps, buttons, laces, magnets, and the like. It is also contemplated within the scope of the invention that at least one of first member 106 and second member 112 comprises an opening adapted to receive adjustable strap 102. It is further contemplated within the scope of the invention that at least one of first member 106 and second member 112 comprises a connecting means such as a hook, a loop, and the like.

Figure 9:
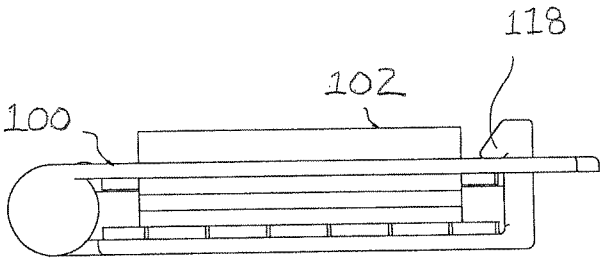
FIG. 9 is a top view of the preferred adjustable strap securing device illustrated in FIGS. 7-8 shown with an exemplary adjustable strap and adjustment device.
Figure 8:
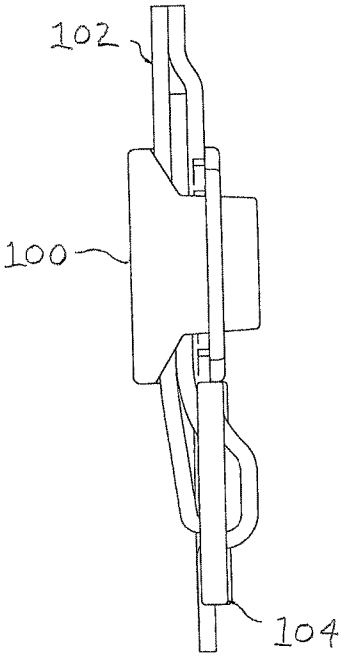
FIG. 8 is a right side view of the preferred adjustable strap securing device illustrated in FIG. 7 shown with an exemplary adjustable strap and adjustment device.

Referring now to FIG. 8, a right side view of preferred adjustable strap securing device 100 is illustrated with exemplary adjustable strap 102 and adjustment device 104. Referring now to FIG. 9, a top view of preferred adjustable strap securing device 100 having protrusion 118 is illustrated with exemplary adjustable strap 102. While FIGS. 7-9 illustrate the preferred configuration and arrangement of adjustable strap securing device 100, it is contemplated within the scope of the invention that the adjustable strap securing device may be of any suitable configuration and arrangement.

Figure 10:
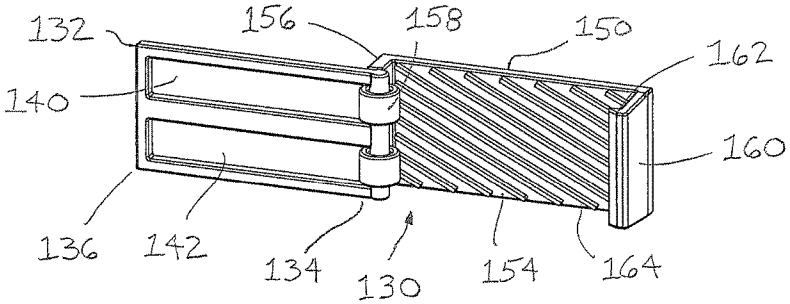
FIG. 10 is a perspective view of a third alternative embodiment of the adjustable strap securing device in accordance with the present invention.

Referring now to FIG. 10, a perspective view of a third alternative embodiment of the adjustable strap securing device in accordance with the present invention is illustrated. As shown in FIG. 10, the third alternative embodiment of the adjustable strap securing device is designated generally by reference numeral 130. Preferred adjustable strap securing device 130 is adapted for use on an adjustable strap (see FIGS. 11-13). Preferred adjustable strap securing device comprises first member 132 which is adapted to receive the adjustable strap and has proximal end 134 and distal end 136. Preferably, first member 132 comprises a pair of openings 140 and 142 which are adapted to receive the adjustable strap (see FIGS. 11-13). Preferred adjustable strap device 130 also comprises second member 150 which defines channel 152 (see FIG. 12). Preferred channel 152 is adapted to receive the adjustable strap. Preferred second member 150 comprises strap-contacting side 154 which is adapted to make contact with the adjustable strap, proximal side 156 which is attached to the strap-contacting side, cylinder 158 which is attached to the proximal side and adapted to receive proximal end 134 of first member 132, distal side 160 which is attached to strap-contacting side 154 and spaced apart from proximal side 156, and a fastening means such as protrusion 162. While FIG. 10 illustrates the fastening means disposed on second member 150, it is contemplated within the scope of the invention that the fastening means may be disposed on the distal end of the first member or both the distal end and the distal side. Preferably, second member 150 also comprises raised portion 164. In the preferred embodiments of adjustable strap securing device 130, proximal side 156 of second member 150 is pivotally connected to proximal end 134 of first member 132, and the fastening means is adapted to releasably retain distal end 136 of first member 132 in channel 152. While FIG. 10 illustrates the preferred configuration and arrangement of the fastening means, it is contemplated within the scope of the invention that the fastening means may be of any suitable configuration and arrangement such as hook and loop fasteners, snaps, buttons, laces, magnets, an aperture, and the like.

Figure 11:
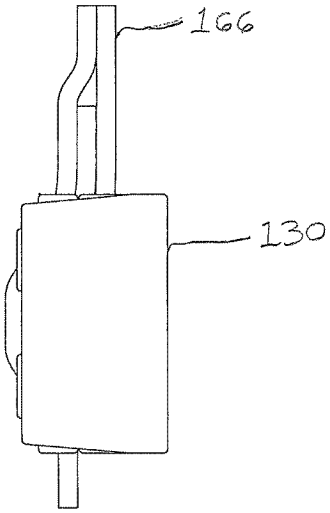
FIG. 11 is a left side view of the preferred adjustable strap securing device illustrated in FIG. 10 shown with an exemplary adjustable strap.
Figure 12:
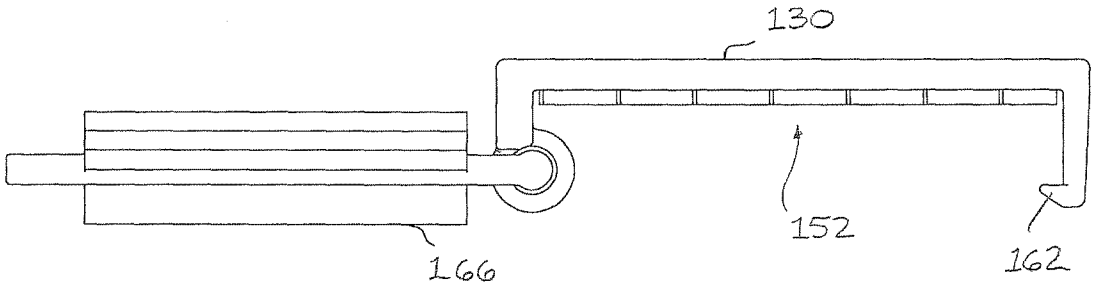
FIG. 12 is a top view of the preferred adjustable strap securing device illustrated in FIGS. 10-11 shown with an exemplary adjustable strap.
Figure 13:
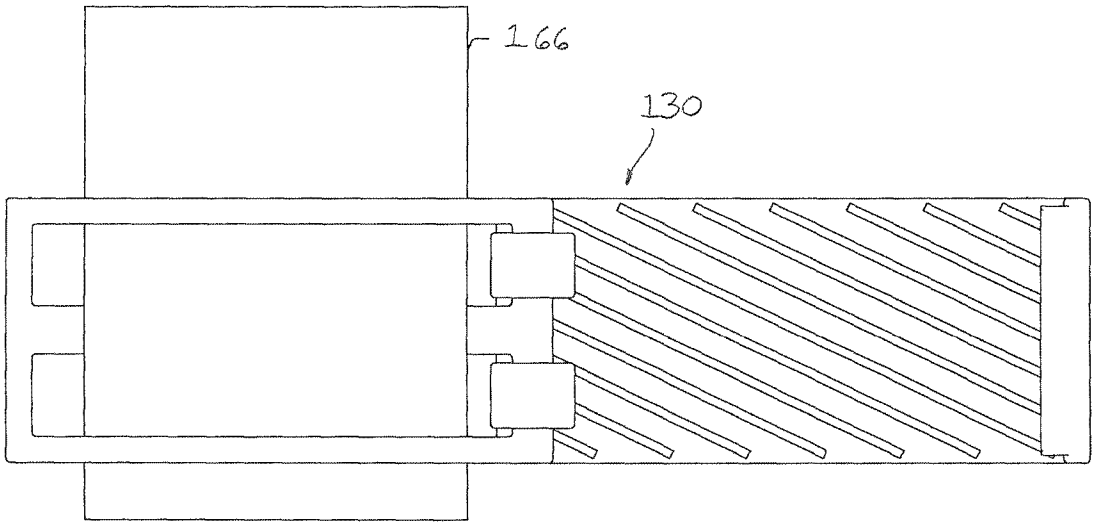
FIG. 13 is a front view of the preferred adjustable strap securing device illustrated in FIGS. 10-12 shown with an exemplary adjustable strap.

Referring now to FIG. 11, a left side view of preferred adjustable strap securing device 130 is illustrated with exemplary adjustable strap 166. Referring now to FIG. 12, a top view of preferred adjustable strap securing device 130 having channel 152 and protrusion 162 is illustrated with exemplary adjustable strap 166. Referring now to FIG. 13, a front view of preferred adjustable strap securing device 130 is illustrated with exemplary adjustable strap 166. While FIGS. 10-13 illustrate the preferred configuration and arrangement of first member 132 and second member 150, it is contemplated within the scope of the invention that the first member and the second member may be of any suitable configuration and arrangement.

Figure 14:
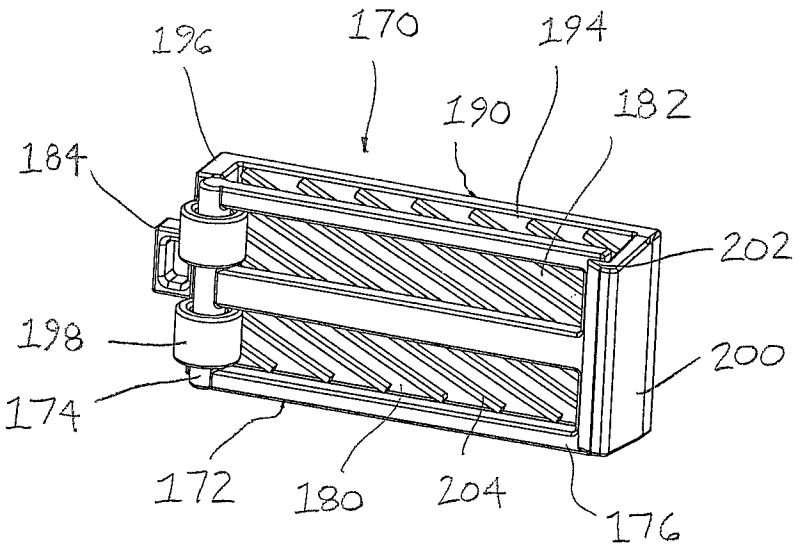
FIG. 14 is a perspective back view of a fourth alternative embodiment of the adjustable strap securing device in accordance with the present invention.

Referring now to FIG. 14, a perspective back view of a fourth alternative embodiment of the adjustable strap securing device in accordance with the present invention is illustrated. As shown in FIG. 14, the fourth alternative embodiment of the adjustable strap securing device is designated generally by reference numeral 170. Preferred adjustable strap securing device 170 is adapted for use on an adjustable strap (see FIGS. 15-18). Preferred adjustable strap securing device comprises first member 172 which is adapted to receive the adjustable strap and has proximal end 174 and distal end 176. Preferably, first member 172 comprises a pair of openings 180 and 182 which are adapted to receive the adjustable strap (see FIGS. 15-18). Preferred adjustable strap device 170 also comprises second member 190 which defines channel 192 (see FIG. 16). Preferred channel 192 is adapted to receive the adjustable strap. Preferred second member 190 comprises strap-contacting side 194 which is adapted to make contact with the adjustable strap, proximal side 196 which is attached to the strap-contacting side, cylinder 198 which is attached to the proximal side and adapted to receive proximal end 174 of first member 172, distal side 200 which is attached to strap-contacting side 194 and spaced apart from proximal side 196, and a fastening means such as protrusion 202. While FIG. 14 illustrates the fastening means disposed on second member 190, it is contemplated within the scope of the invention that the fastening means may be disposed on the distal end of the first member or both the distal end and the distal side. Preferably, second member 190 also comprises raised portion 204 and a connecting means such as loop 184 which is adapted to be used to connect preferred adjustable strap securing device 170 to another similar device. In the preferred embodiments of adjustable strap securing device 170, proximal side 196 of second member 190 is pivotally connected to proximal end 174 of first member 172, and the fastening means is adapted to releasably retain distal end 176 of first member 172 in channel 192. While FIG. 14 illustrates the preferred configuration and arrangement of the connecting means, it is contemplated within the scope of the invention that the connecting means may be of any suitable configuration and arrangement such as hook and loop fasteners, snaps, buttons, laces, magnets, and the like. It is also contemplated within the scope of the invention that the connecting means may be disposed on the second member.

Figure 15:
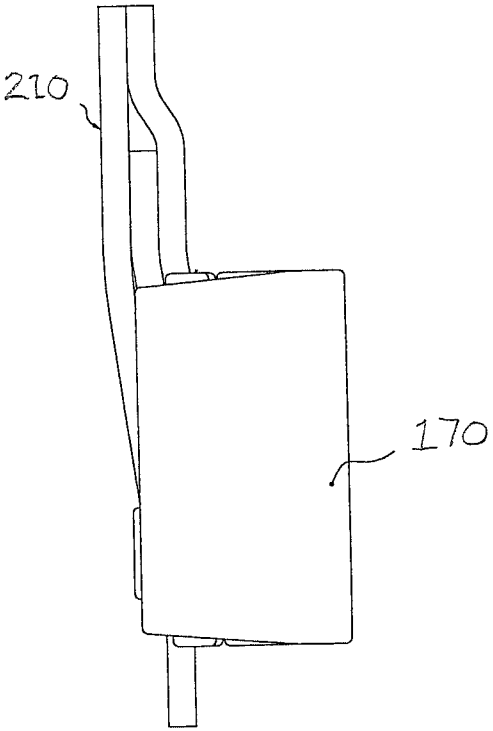
FIG. 15 is a left side view of the preferred adjustable strap securing device illustrated in FIG. 14 shown with an exemplary adjustable strap.

Referring now to FIG. 15, a left side view of preferred adjustable strap securing device 170 is illustrated with exemplary adjustable strap 210. Referring now to FIG. 16, a bottom view of preferred adjustable strap securing device 170 having channel 192 and connecting means 194 is illustrated with exemplary adjustable strap 210. Referring now to FIG. 17, a back view of preferred adjustable strap securing device 170 having connecting means 194 is illustrated with exemplary adjustable strap 210. While FIGS. 14-17 illustrate the preferred configuration and arrangement of the first member and the second member, it is contemplated within the scope of the invention that the first member and the second member may be of any suitable configuration and arrangement.

Referring now to FIG. 18, a perspective back view of a fifth alternative embodiment of the adjustable strap securing device in accordance with the present invention is illustrated. As shown in FIG. 18, the fifth alternative embodiment of the adjustable strap securing device is designated generally by reference numeral 220. Preferred adjustable strap securing device 220 is adapted for use on an adjustable strap (see FIGS. 19-20). Preferred adjustable strap securing device comprises first member 222 which is adapted to receive the adjustable strap and has proximal end 224 and distal end 226. Preferably, first member 222 comprises a pair of openings 230 and 232 which are adapted to receive the adjustable strap (see FIGS. 15-18). Preferred adjustable strap device 220 also comprises second member 240 which defines channel 242 (see FIG. 20). Preferred channel 242 is adapted to receive the adjustable strap. Preferred second member 240 comprises strap-contacting side 244 which is adapted to make contact with the adjustable strap, proximal side 246 which is attached to the strap-contacting side, cylinder 248 which is attached to the proximal side and adapted to receive proximal end 224 of first member 222, distal side 250 which is attached to strap-contacting side 244 and spaced apart from proximal side 246, and a fastening means such as protrusion 252. While FIG. 18 illustrates the fastening means disposed on second member 240, it is contemplated within the scope of the invention that the fastening means may be disposed on the distal end of the first member or both the distal end and the distal side. Preferably, second member 240 comprises raised portion 254 and a connecting means such as hook 234 which is adapted to be used to connect preferred adjustable strap securing device 220 to another similar device. In the preferred embodiments of adjustable strap securing device 220, proximal side 246 of second member 240 is pivotally connected to proximal end 224 of first member 222, and the fastening means is adapted to releasably retain distal end 226 of first member 222 in channel 242. While FIG. 18 illustrates the preferred configuration and arrangement of the connecting means, it is contemplated within the scope of the invention that the connecting means may be of any suitable configuration and arrangement such as hook and loop fasteners, snaps, buttons, laces, magnets, and the like. It is also contemplated within the scope of the invention that the connecting means may be disposed on the second member.

Referring now to FIG. 19, a back view of preferred adjustable strap securing device 220 having connecting means 234 is illustrated with exemplary adjustable strap 260. Referring now to FIG. 20, a bottom view of preferred adjustable strap securing device 220 having connecting means 234 and channel 242 is illustrated with exemplary adjustable strap 260. While FIGS. 18-20 illustrate the preferred configuration and arrangement of first member 222 and second member 240, it is contemplated within the scope of the invention that the first member and the second member may be of any suitable configuration and arrangement.

Figure 21:
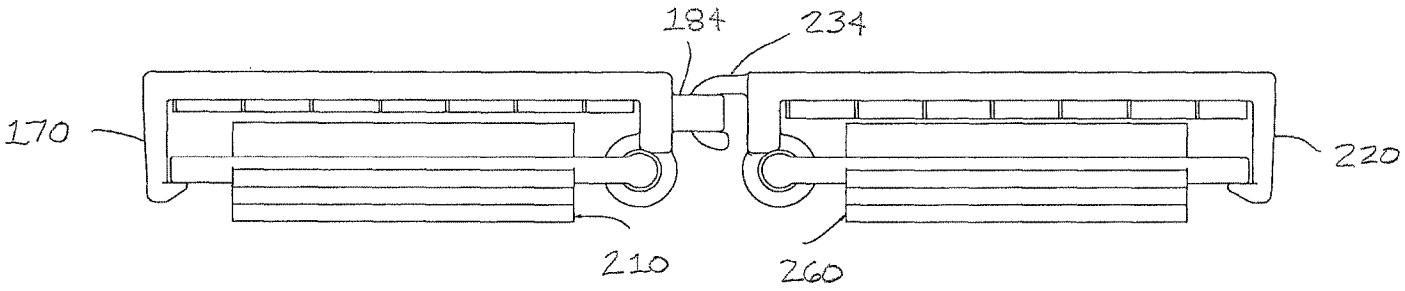
FIG. 21 is a top view of the fourth alternative embodiment illustrated in FIGS. 14-17 and the fifth alternative embodiment illustrated in FIGS. 18-20 releasably attached to each other.
Figure 22:
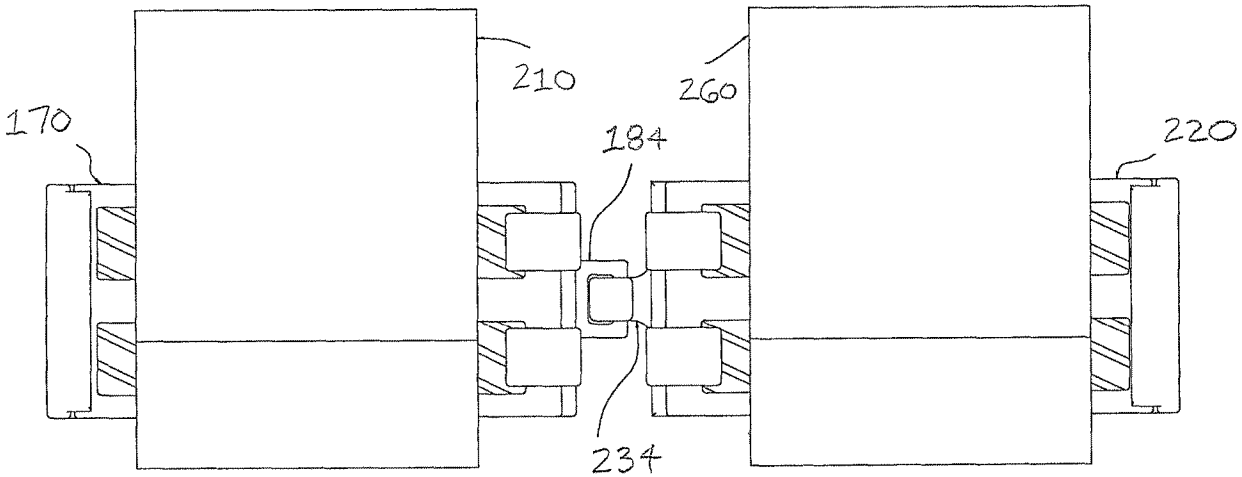
FIG. 22 is a front view of the fourth and fifth alternative embodiments releasably attached to each other.

Referring now to FIG. 21, a top view of the fourth and fifth alternative embodiments releasably attached to each other is illustrated. As shown in FIG. 21, preferred adjustable strap securing device 170 having loop 184 and preferred adjustable strap securing device 220 having hook 234 are adapted to be releasably attached to each other. Referring now to FIG. 22, a front view of preferred adjustable strap securing device 170 releasably attached to preferred adjustable strap securing device 220 is illustrated.

The invention also comprises a method for securing an adjustable strap. The preferred method comprises providing an adjustable strap securing device as described hereinabove. The preferred method further comprises securing the adjustable strap securing device around the adjustable strap.

In operation, several advantages of the preferred embodiments of the adjustable strap securing device are achieved. For example, the preferred embodiments of the adjustable strap securing device sufficiently retain the desired length of the adjustable strap. The preferred embodiments of the adjustable strap securing device also do not damage the adjustable strap. Further, the preferred embodiments of the adjustable strap securing device are aesthetically appealing. Still further, the preferred embodiments of the adjustable strap securing device are adapted to be removably attached to another adjustment device.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. An adjustable strap securing device adapted for use on an adjustable strap, said adjustable strap securing device comprising:

(a) a first member, said first member having a first member proximal end, a first member distal end, and a pair of openings;

(b) a second member, said second member having a second member proximal end and a second member distal end;

(c) a fastening means disposed on at least one of the first member distal end and the second member distal end;

wherein the second member proximal end is pivotally attached to the first member proximal end; and wherein the fastening means is adapted to releasably retain the first member and the second member around the adjustable strap; and wherein the first member and the second member contact the adjustable strap when the fastening means releasably retains the first member and the second member around the adjustable strap and wherein the pair of openings in the first member are adapted to receive and adjust the adjustable strap; and wherein at least one of the first member and the second member comprises a hook.

2. The adjustable strap securing device of claim 1 wherein the fastening means comprises a protrusion.

3. The adjustable strap securing device of claim 1 wherein at least one of the first member and the second member comprises a raised portion.

4. The adjustable strap securing device of claim 1 wherein at least one of the first member and the second member comprises an opening adapted to receive the adjustable strap.

5. An adjustable strap securing device adapted for use on an adjustable strap, said adjustable strap securing device comprising:

(a) a first member, said first member having a pair of openings to receive the adjustable strap, a proximal end, and a distal end;

(b) a second member, said second member defining a channel adapted to receive the adjustable strap and comprising:

(i) a strap-contacting side, said strap-contacting side being adapted to make contact with the adjustable strap;

(ii) a proximal side, said proximal side being attached to the strap-contacting side;

(iii) a cylinder, said cylinder being attached to the proximal side and being adapted to receive the proximal end of the first member;

(iv) a distal side, said distal side being attached to the strap-contacting side and spaced apart from the proximal side;

(v) a fastening means, said fastening means being disposed on at least one of the distal end and the distal side;

wherein the proximal side of the second member is pivotally connected to the proximal end of the first member; and wherein the fastening means is adapted to releasably retain the distal end of the first member in the channel; and wherein the pair of openings in the first member are adapted to receive and adjust the adjustable strap; and wherein at least one of the first member and the second member comprises a hook.

6. The adjustable strap securing device of claim 5 wherein the fastening means comprises a protrusion.

7. The adjustable strap securing device of claim 5 wherein at least one of the first member and the second member comprises a raised portion.

8. The adjustable strap securing device of claim 5 wherein at least one of the first member and the second member comprises an opening adapted to receive the adjustable strap.

9. A method for securing an adjustable strap, said method comprising:

(a) providing an adjustable strap securing device, said adjustable strap securing device comprising:

(i) a first member, said first member having a pair of openings to receive the adjustable strap, a proximal end, and a distal end;

(ii) a second member, said second member defining a channel adapted to receive the adjustable strap and comprising:

(1) a strap-contacting side, said strap-contacting side being adapted to make contact with the adjustable strap;

(2) a proximal side, said proximal side being attached to the strap-contacting side;

(3) a cylinder, said cylinder being attached to the proximal side and being adapted to receive the proximal end of the first member;

(4) a distal side, said distal side being attached to the strap-contacting side and spaced apart from the proximal side;

(5) a fastening means, said fastening means being disposed on at least one of the distal end and the distal side;

wherein the proximal side of the second member is pivotally connected to the proximal end of the first member; and wherein the fastening means is adapted to releasably retain the distal end of the first member in the channel; and wherein the pair of openings in the first member are adapted to receive and adjust the adjustable strap; and wherein at least one of the first member and the second member comprises a hook;

(b) securing the adjustable strap securing device around the adjustable strap.

* * * * *